US007333060B2

(12) United States Patent
Ando

(10) Patent No.: US 7,333,060 B2
(45) Date of Patent: Feb. 19, 2008

(54) PLANAR ANTENNA

(75) Inventor: Koji Ando, Kyoto-Fu (JP)

(73) Assignee: Omron Corporation, Kyoto (JP)

( * ) Notice: Subject to any disclaimer, the term of this patent is extended or adjusted under 35 U.S.C. 154(b) by 22 days.

(21) Appl. No.: 11/330,319

(22) Filed: Jan. 12, 2006

(65) Prior Publication Data

US 2006/0187123 A1 Aug. 24, 2006

(51) Int. Cl.
*H01Q 1/38* (2006.01)

(52) U.S. Cl. ..... 343/700 MS; 343/752; 343/846

(58) Field of Classification Search ..... 343/700 MS, 343/752
See application file for complete search history.

(56) References Cited

U.S. PATENT DOCUMENTS

| | | | |
|---|---|---|---|
| 5,181,044 A | 1/1993 | Matsumoto et al. | |
| 2002/0104615 A1 | 8/2002 | Lebaric et al. | |
| 2004/0147288 A1 | 7/2004 | Belhora | |
| 2005/0190106 A1* | 9/2005 | Anguera et al. | 343/700 MS |
| 2006/0227052 A1* | 10/2006 | Tavassoli Hozouri | 343/700 MS |

FOREIGN PATENT DOCUMENTS

| | | |
|---|---|---|
| EP | 0 346 922 | 12/1989 |
| EP | 1 130 678 A2 | 9/2001 |
| WO | WO 01/08261 A1 | 2/2001 |
| WO | WO 2005/093898 | 10/2005 |

OTHER PUBLICATIONS

Naftali Herscovici, "New Considerations in the Design of Microstrip Antennas", IEEE Transcriptions on Antennas and Propagation, vol. 46, No. 6, Jun. 1998.

* cited by examiner

*Primary Examiner*—Trinhh Vo Dinh
(74) *Attorney, Agent, or Firm*—Dickstein Shapiro LLP

(57) ABSTRACT

A planar antenna able to secure a wide frequency band and having high reliability. Therefore, the planar antenna has at least a grounding plate, a radiating conductor, a matching portion, a power supply portion, a spacer, a central conductor and a coaxial connector. The matching portion is a flat plate having a taper shape (an inverse taper shape) narrowed in width from the power supply portion to the radiating conductor. Further, the matching portion is slantingly arranged with respect to the grounding plate.

16 Claims, 10 Drawing Sheets

PLANAR ANTENNA

CROSS-REFERENCE TO RELATED APPLICATIONS

This application is based on and claims priority to Japanese Patent Application No. 2005-006890 filed on Jan. 13, 2005 in the Japanese Patent Office, the entire contents of which are incorporated by reference herein.

FIELD OF THE INVENTION

The present invention relates to a planar antenna, and more particularly, relates to a planar antenna having a wide frequency band and high reliability. Further, the present invention relates to an antenna device and a RFID system having the above planar antenna.

BACKGROUND OF THE INVENTION

A patch antenna is a planar antenna constructed such that a dielectric substrate forming a patch electrode on its upper face is arranged on a ground face, and a predetermined high frequency electric current is supplied to this patch electrode through a power supply terminal, etc. For example, the patch antenna is used as various antennas such as a base station antenna, etc. in a communication system of a portable telephone, etc.

FIGS. 11A and 11B show the structure of a patch antenna 20 using the dielectric substrate. FIG. 11A is a plan view of the patch antenna 20. FIG. 11B is a cross-sectional view seen from line B-B' of the patch antenna 20 shown in FIG. 11A. As shown in FIG. 11B, in the patch antenna 20, an antenna radiating element 22 is formed from copper foil in a pattern on one face of the dielectric substrate 21. Further, a GND 23 is formed on the side opposite the antenna radiating element 22 through the dielectric substrate 21. In the patch antenna 20 shown in FIGS. 11A and 11B, the input impedance of an edge of the antenna radiating element 22 is 200 ohms or more. Therefore, when a signal of 50 ohms is input from a communication device, etc. to the edge of the antenna radiating element 22 as it is, loss of power due to reflection is increased.

Therefore, a power supply method such as offset power supply is used. In the offset power supply, as shown in FIG. 11A, a signal is not supplied from the edge of the antenna radiating element 22, but is supplied from an internal area A of the antenna radiating element 22 lower in impedance than the edge. Thus, the impedance is matched and the loss of power due to reflection is reduced. Further, in the patch antenna 20, a central conductor 27 of a coaxial line path is connected to a power supply point 24 of the antenna radiating element 22, and a coaxial connector 28 of the coaxial line path is connected to the GND 23 of the patch antenna 20. There is an antenna element disclosed in JP-A-2004-260786 (laid-open on Sep. 16, 2004) as one example of the antenna having such a structure.

In the power supply method, a method for supplying power by arranging a matching portion 25 as shown in FIG. 12 is also generally well utilized as well as the offset power supply (see Japanese patent No. 3,273,402 (registered on Feb. 1, 2002)). However, in each of these methods, a patch antenna 20' using the general dielectric substrate 21 has a high Q-value and a narrow frequency band. For example, if the frequency band is a 1 GHz band, it is very difficult to ensure that VSWR (Voltage Standing Wave Ratio) is 1.5 or less and the frequency band is 10 MHz or more even if a parasitic element is formed when a glass epoxy substrate of t=1.6 mm in thickness is used as the dielectric substrate 21.

Therefore, there is also a method for forming the patch antenna through a layer having a dielectric constant of 1, i.e., the air to widen the frequency band. FIGS. 13A and 13B show the structure of a patch antenna 20" in which the air layer is trapped. FIG. 13A is a plan view of the patch antenna 20". FIG. 13B is a cross-sectional view seen from line B-B' of the patch antenna 20" shown in FIG. 13A. The patch antenna 20" is structurally the same as the patch antenna 20 of FIGS. 11A and 11B using the dielectric substrate 21. However, an air gap area G is arranged between the radiating element 22 and the GND 23 to secure a wide frequency band. A spacer 26 is arranged in the air gap area G, and maintains the distance between the radiating element 22 and the GND 23. Specifically, the patch antenna 20" of FIGS. 13A and 13B secures a wide frequency band by widely designing the width of the patch antenna having only the thickness of the dielectric substrate 21 in the patch antenna 20 of FIGS. 11A and 11B.

However, in the patch antenna 20 of FIGS. 11A and 11B, the coaxial connector 8 is arranged on the rear face of the patch antenna 20. Therefore, when the patch antenna 20 is arranged in a wall, etc., the coaxial connector 8 becomes an obstacle. Specifically, there is a limit to the degree of freedom of the configuration. Further, in the patch antenna 20" of FIGS. 13A and 13B, as mentioned above, a wide frequency band can be also secured by arranging the air gap area G between the radiating element 22 and the GND 23, but the coaxial connector 28 is obliged to be arranged on the rear face of the GND 23 as shown in FIGS. 13A and 13B when the offset power supply is performed. Accordingly, similar to the patch antenna 20 of FIGS. 11A and 11B, there is a limit in the degree of freedom of the configuration.

With respect to the degree of freedom of the configuration, a patch antenna 20'" having another structure is shown in FIGS. 14A and 14B. FIG. 14A is a plan view of the patch antenna 20'". FIG. 14B is a cross-sectional view seen from line B-B' of the patch antenna 20'" shown in FIG. 14A. As shown in FIG. 14B, this patch antenna 20'" is set to a structure in which no coaxial connector 28 is arranged on the rear face of the GND 23. Thus, the above restriction of the arrangement is not removed.

However, in the patch antenna 20" of FIGS. 13A and 13B and the patch antenna 20'" of FIGS. 14A and 14B, the wide frequency band can be secured, but a problem exists in that the central conductor 27 of the coaxial line path is in a very unstable state.

For example, in both the patch antenna 20" shown in FIGS. 13A and 13B and the patch antenna 20'" shown in FIGS. 14A and 14B, the distance between the radiating element 22 and the GND 23 is widely set. Therefore, the wide frequency band can be secured, but the central conductor 27 of the coaxial line path attains a very unstable state without supporting this central conductor 27 by another member within this air gap area G. In such a state, the central conductor 27 is easily deteriorated in characteristics by an impact from the exterior, a vibration at a manufacturing time, etc.

Further, it is necessary to closely arrange the central conductor 27 on the coaxial line path between the radiating element 22 and the GND 23. Therefore, a problem exists in that assembly work property is very poor. Further, in the patch antenna 20" of FIGS. 13A and 13B, there is a case in which the central conductor 27 of the coaxial line path is connected to the radiating element 22 in a curved state during manufacturing. In this case, a problem exists in that an individual difference of the antenna characteristics is caused in accordance with a degree of curvature of the central conductor 27.

With respect to the assembly work property, there is a patch antenna 20"" of the structure shown in FIGS. 15A and 15B. FIG. 15A is a plan view of the patch antenna 20"". FIG. 15B is a cross-sectional view seen from line B-B' of the patch antenna 20"" shown in FIG. 15A. As shown in FIG. 15A, the connecting work property of the central conductor 27 of the coaxial line path to the radiating element 22 can be raised by arranging a matching portion 25.

However, in the patch antenna 20"" of FIGS. 15A and 15B, a problem exists in that the size of the patch antenna 20"" itself is increased. Specifically, in the patch antenna 20"" of FIGS. 15A and 15B, a power supply system for arranging the matching portion 25 is used instead of the offset power supply system. Therefore, in comparison with the case adopting the offset power supply system, the size of the patch antenna is increased by an area (length) corresponding to the matching portion 25.

BRIEF SUMMARY OF THE INVENTION

Therefore, the present invention is made in consideration of the above problems, and its object is to provide a planar antenna for connecting the matching portion to the radiating element, and having a wide frequency band and high reliability by arranging this matching portion utilizing the air gap area of a radiating conductor and a grounding plate.

To solve the above problems, a planar antenna of the present invention includes a radiating conductor and a grounding plate spaced from each other by a predetermined distance and oppositely arranged, and a matching portion in which a power supply portion for supplying power to the radiating conductor is arranged at one end of the matching portion, and the other end of the matching portion is connected to the radiating conductor, wherein the matching portion is arranged such that the power supply portion and the grounding plate are spaced from each other by a distance shorter than the predetermined distance. For example, in the planar antenna of the present invention, the matching portion is preferably arranged such that the distance between the matching portion and the grounding plate is gradually shortened from an end connected to the radiating conductor to an end having the power supply portion.

In accordance with the above construction, in the planar antenna of the present invention, the frequency band can be widely secured and the antenna can be made compact.

The radiating conductor is spaced from the grounding plate by a predetermined distance and is arranged so as to be opposed to the grounding plate. Thus, in comparison with a case in which the radiating conductor is arranged on the grounding plate, the Q-value is small so that the frequency band can be widely secured.

Further, the impedance of a communication device and the impedance of the radiating conductor are easily matched by arranging the matching portion. Accordingly, for example, even when the impedance near a power supply area of the radiating conductor is 200 ohms and a 50 ohm signal is inputted from the communication device, the loss of power due to reflection can be greatly reduced.

In the above conventional patch antenna, there is also the construction in which the matching portion is arranged and the radiating conductor is spaced from the grounding plate by a predetermined distance and is arranged so as to be opposed to the grounding plate. However, in this patch antenna, the matching portion is located on the same face as the radiating conductor spaced from the grounding plate by the predetermined distance and arranged so as to be opposed to the grounding plate. Therefore, the size of the patch antenna is increased. In contrast to this, the planar antenna of the present invention is arranged such that the distance between the matching portion and the grounding plate is continuously shortened from the end connected to the above radiating conductor to the arranging end of the above power supply portion. Specifically, in the planar antenna of the present invention, the matching portion is arranged in the distance (space) from the grounding plate to the radiating conductor so that this space is effectively utilized. Thus, for example, when the matching portion of the same size is arranged, the planar antenna of the present invention can be reduced in size in comparison with the conventional antenna.

Accordingly, in accordance with the construction of the present invention, the frequency band can be widely secured, and compactness of the antenna itself can be realized.

Further, in the planar antenna of the present invention, a central conductor connected to the power supply portion, and a coaxial connector formed on a coaxial line path with this central conductor are preferably arranged on the arranging side of the radiating conductor and the matching portion in the grounding plate.

In accordance with the above construction, the degree of freedom of the arrangement of the planar antenna of the present invention can be improved.

In the conventional construction in which the coaxial connector formed on the same axis as the central conductor is arranged on the rear face of the patch antenna, this coaxial connector becomes an obstacle when the patch antenna is arranged in a wall, etc. Accordingly, it was difficult to arrange the patch antenna. Therefore, in accordance with the construction of the present invention, the coaxial connector is arranged on the arranging side of the radiating conductor and the matching portion in the grounding plate. Therefore, the degree of freedom of the arrangement is improved and the antenna is easily arranged in a wall, which is conventionally difficult.

Further, in the planar antenna of the present invention, the matching portion is arranged between the grounding plate and the radiating conductor. Therefore, the distance from the power supply portion to the coaxial connector is very shortened in comparison with the conventional case. Thus, the length of the central conductor arranged between the grounding plate and the radiating conductor is greatly shortened in comparison with the conventional patch antenna. Accordingly, it is possible to avoid that the central conductor attains an unstable state between the grounding plate and the radiating conductor.

Specifically, it is possible to reduce the deterioration of characteristics caused by applying an external impact, a vibration at a manufacturing time, etc. to the central conductor. Accordingly, in accordance with the above construction, the stability of quality can be improved.

Further, in comparison with the conventional patch antenna, the required length of the central conductor is shortened. Therefore, in comparison with the conventional case, the planar antenna can be manufactured by restraining manufacture cost.

Further, in the planar antenna in the present invention, it is preferable that a notch portion is arranged in the radiating conductor from its outer circumference to the center, and one end of the matching portion is connected to an outer edge of the central side of the notch portion.

In accordance with the above construction, power is supplied from the center of the radiating conductor lower in impedance than the edge (outer circumference) of the radiating conductor. Thus, the impedance can be more accurately matched, and the loss due to reflection can be further reduced.

Further, in the planar antenna in the present invention, the matching portion is preferably gradually widened in width from an end connected to the radiating conductor to an end having the power supply portion.

In accordance with the above construction, the characteristic impedance is gradually changed and can be matched with the impedance near the power supply area of the radiating conductor.

Further, in the planar antenna in the present invention, a parasitic element is preferably arranged on the side opposed to the arranging side of the grounding plate in the radiating conductor such that the parasitic element is spaced from the radiating conductor by a predetermined distance and is opposed to the radiating conductor.

In accordance with the above construction, a wider frequency band can be secured by arranging the parasitic element.

Further, an antenna device in the present invention comprises: the above planar antenna; and a reader-writer for receiving information transmitted from the planar antenna, and/or transmitting information to the planar antenna.

In accordance with the above construction, the antenna device of the present invention has the planar antenna having the above effects. Therefore, for example, when the antenna device is set to a gate antenna, the arranging space of the gate in a wall can be reduced in comparison with the conventional antenna.

The reader-writer can be arranged in a place difficult to make a collision. However, since the antenna is obliged to be arranged on the front face of a signal generating source of received information, the arrangement is restricted. In this case, when the conventional antenna of the construction for arranging the coaxial connector on the rear face of the grounding plate (GND plate) is arranged, the antenna is greatly projected forward from the arranged wall. For example, when the antenna device is the gate antenna and the antenna is greatly projected from the wall of the gate, there is a possibility that the antenna comes in contact with an article and a conveying device moved within the gate and both the antenna and the article and the conveying device are damaged. Therefore, in the antenna device of the present invention, no coaxial connector is arranged on the rear face of the grounding plate of the planar antenna. Therefore, it is possible to reduce the arranging space (particularly, a space required in the direction projected from the wall for arranging the planar antenna). Accordingly, compactness of the gate antenna itself can be realized.

Further, the planar antenna having the matching portion arranged in an area between the grounding plate and the radiating conductor is arranged. Therefore, when the planar antenna is arranged in the wall of the antenna device (e.g., the gate antenna), the horizontal size of the planar antenna with respect to the wall can be reduced.

Further, a RFID system in the present invention comprises: a wireless IC tag; the above planar antenna; and a reader-writer for receiving information recorded to the wireless IC tag transmitted from the planar antenna, and/or transmitting the information recorded to the wireless IC tag to the planar antenna.

The RFID system used in article circulation and distribution can be suitably used even in an article circulating spot having many restricting conditions in the arrangement by arranging the planar antenna having the above effects.

As mentioned above, the planar antenna of the present invention comprises: the radiating conductor and the grounding plate spaced from each other by a predetermined distance and oppositely arranged; and the matching portion in which a power supply portion for supplying power to the radiating conductor is arranged at one end of the matching portion, and the other end of the matching portion is connected to the radiating conductor; wherein the matching portion is arranged such that the power supply portion and the grounding plate are spaced from each other by a distance shorter than the predetermined distance.

In accordance with the above construction, the frequency band can be widely secured since the radiating conductor is spaced from the grounding plate by a predetermined distance and is arranged so as to be opposed to the grounding plate.

Further, in accordance with the above construction, the matching portion is arranged such that the distance between the matching portion and the grounding plate is continuously shortened from the end connected to the above radiating conductor to the arranging end of the above power supply portion. Therefore, the matching portion is arranged by effectively utilizing the distance (space) from the grounding plate to the radiating conductor. Thus, for example, when the matching portion of the same size as the conventional matching portion is arranged, the antenna can be realized by reducing its size in comparison with the conventional antenna in accordance with the construction of the present invention.

In accordance with the above construction, in the planar antenna of the present invention, the frequency band can be widely secured and the antenna can be made compact.

DESCRIPTION OF THE PREFERRED EMBODIMENTS (Embodiment 1)

An exemplary embodiment of the present invention will next be explained with respect to FIGS. 1 to 5.

Figure 1:
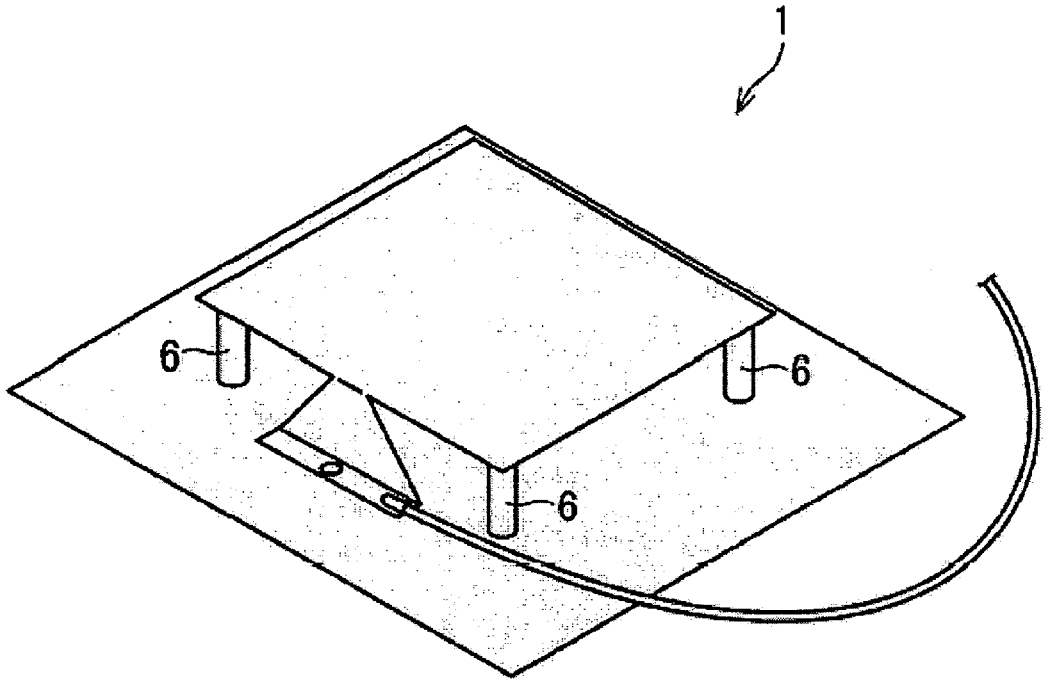
FIG. 1 is a perspective view showing the outer shape of a planar antenna in an exemplary embodiment of the present invention.
Figure 2:
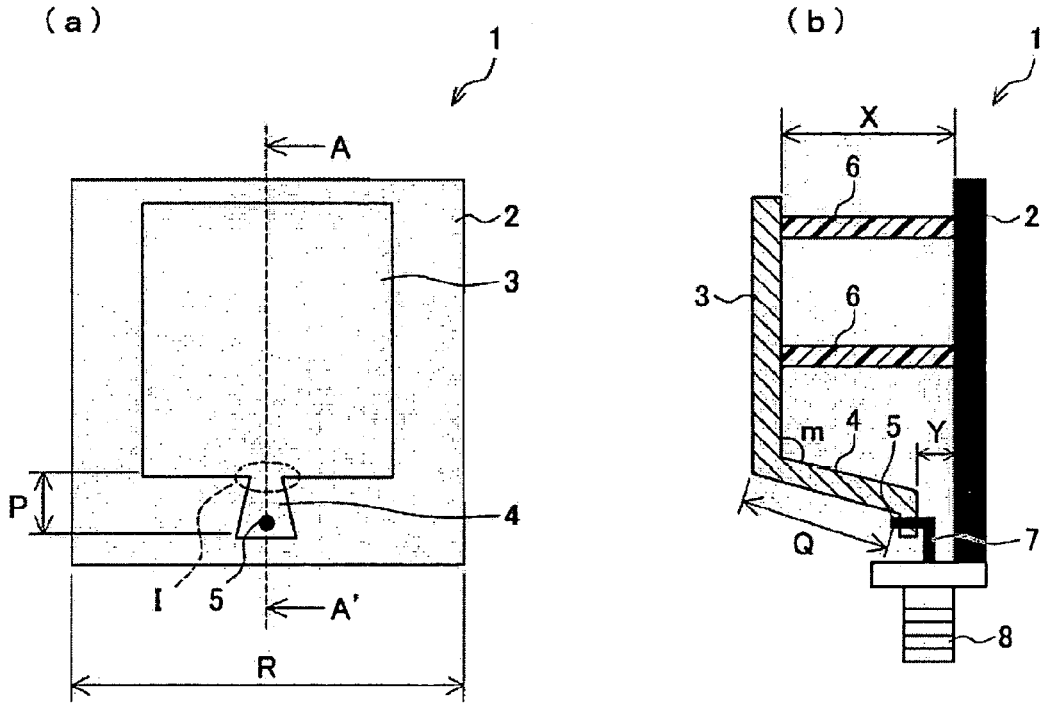
FIG. 2A is a plan view of the planar antenna shown in FIG. 1.
FIG. 2B is a cross-sectional view seen from line A-A' of the planar antenna shown in FIG. 2A.

FIG. 1 is a perspective view showing the outer shape of a planar antenna 1 in this embodiment. For example, the planar antenna 1 shown in FIG. 1 is arranged in a reader-writer, and can be used to transmit and receive a radio wave. In the following description, for convenience of the explanation, characteristics, etc. of the planar antenna will be explained by supposing a case for transmitting the radio wave by using the planar antenna. However, these characteristics, etc. are also approximately similarly formed with respect to a case for receiving the radio wave by using the planar antenna.

In the following description, the planar antenna 1 will be explained in detail with respect to FIGS. 2A and 2B. FIGS. 2A and 2B show the construction of the planar antenna 1. FIG. 2A is a plan view of the planar antenna 1. FIG. 2B is a cross-sectional view seen from a direction in which the planar antenna 1 shown in FIG. 2A is cut by a line segment A-A'. As shown in FIG. 2B, the planar antenna 1 has at least a grounding plate 2, a radiating conductor 3, a matching portion 4, a power supply portion 5, a spacer 6, a central conductor 7 and a coaxial connector 8.

As shown in FIG. 2A, the radiating conductor 3 is arranged near the center of the grounding plate 2, and the matching portion 4 is connected to the radiating conductor 3. As shown in FIG. 2B, in the planar antenna 1, the grounding plate 2 and the radiating conductor 3 are spaced from each other by a predetermined distance X and are oppositely arranged through the spacer 6. The radiating conductor 3 is connected to one end of the matching portion 4, and the power supply portion 5 is arranged at the other end of the matching portion 4. The central conductor 7 of a coaxial line path is connected to the power supply portion 5. This central conductor 7 is connected to the coaxial connector 8 of the coaxial line path.

The material of the above grounding plate 2 is not particularly limited if this grounding plate 2 is formed by a metallic material. However, an aluminum material can be used in consideration of processing property and corrosive property. The thickness of the grounding plate 2 is not particularly limited, but can be set to about 2 to 3 mm, for example.

The above radiating conductor 3 is an electrode constructed by a conductor. The radiating conductor 3 has a so-called rectangular shape in which one of two pairs of opposite sides is longer than the other. For example, the radiating conductor 3 can be constructed by using a metallic material.

The above matching portion 4 is arranged to match the impedance of a signal input from a communication device (not shown) and the impedance of the radiating conductor 3. One end of the matching portion 4 is connected to one end of the above radiating conductor 3, and the power supply portion 5 for supplying power to the radiating conductor 3 is arranged at the other end of the matching portion 4.

Since the matching portion 4 is arranged, for example, loss of power due to reflection can be greatly reduced when the impedance of the vicinity of a power supply area (an area I shown by a broken line of FIG. 2A) of the radiating conductor 3 is 200 ohms and the impedance of a signal inputted from the communication device, etc. is 50 ohms. When the signal having 50 ohms in impedance is directly input to the power supply area of the radiating conductor 3 having about 200 ohms in impedance without interposing the matching portion, the power of the signal is reflected since the difference in impedance between the above signal and the power supply area is large. Therefore, a loss of power is caused. Specifically, the planar antenna 1 can greatly reduce the loss of power due to reflection by arranging the matching portion 4.

Further, as shown in FIG. 2A, the above matching portion 4 is a flat plate having a taper shape (an inverse taper shape) narrowed in width from the power supply portion 5 to the radiating conductor 3. Thus, the characteristic impedance is gradually changed and can be matched with the impedance near the power supply area I of the radiating conductor 3.

Further, as shown in FIG. 2B, the above matching portion 4 is slantingly arranged with respect to the grounding plate 2. For example, a connecting portion of the radiating conductor 3 and the matching portion 4 is separated from the grounding plate 2 by a distance X. The power supply portion 5 of the matching portion 4 is separated from the grounding plate 2 by a distance Y. Specifically, the matching portion 4 is arranged from the end connected to the radiating conductor 3 to the end having the power supply portion 5 so as to continuously shorten the distance between the matching portion 4 and the grounding plate 2. Since this construction is set, the matching portion 4 can be arranged by effectively utilizing a space from the grounding plate 2 to the radiating conductor 3. For example, when the length of the matching portion of a conventional antenna having the matching portion and the radiating substrate constructed in the same plane is set to a length Q (FIG. 2B), the matching portion 4 can be arranged by effectively utilizing the space from the grounding plate 2 to the radiating conductor 3 in the construction of the planar antenna 1. The length Q (FIG. 2B) of the matching portion 4 itself is shortened as shown by a distance P in the planar antenna 1 shown in FIG. 2A. Specifically, compactness of the planar antenna 1 itself can be realized by setting the construction of the present invention.

For example, an inclination angle m (FIG. 2B) of the matching portion 4 with respect to the radiating conductor 3 can be set to 25 to 35 degrees, preferably, 30 degrees in the case of a UHF band antenna. However, the inclination angle is not limited to this angle.

The above power supply portion 5 is arranged at one end of the matching portion 4 to supply a signal (i.e., power) to the radiating conductor 3 through the matching portion 4, and the central conductor 7 is connected to this power supply portion 5. Accordingly, the end of the above matching portion 4 for arranging the power supply portion 5 has no inclination as mentioned above so as to cause no obstacle in the connection of the central conductor 7 and the power supply portion 5, and is arranged so as to be opposed to the grounding plate 2 as shown in FIG. 2B.

The power supply portion 5 and the grounding plate 2 are spaced from each other by a distance Y (FIG. 2B) shorter than the distance between the grounding plate 2 and the radiating conductor 3. For example, this distance Y is preferably set to a range of 3 to 5 mm, and is more preferably set to 4 mm in the case of the UHF band antenna. However, this distance is not limited to the above range, but can be suitably set in accordance with the relation of the distance Y and the distance X (FIG. 2B) between the radiating conductor 3 and the grounding plate 2, and a using object (using band) of the planar antenna 1.

One end of the above central conductor 7 is connected to the above power supply portion 5, and the other end of the central conductor 7 is connected to the coaxial connector 8. For example, the central conductor 7 can be constructed by using a metallic material.

Figure 13:
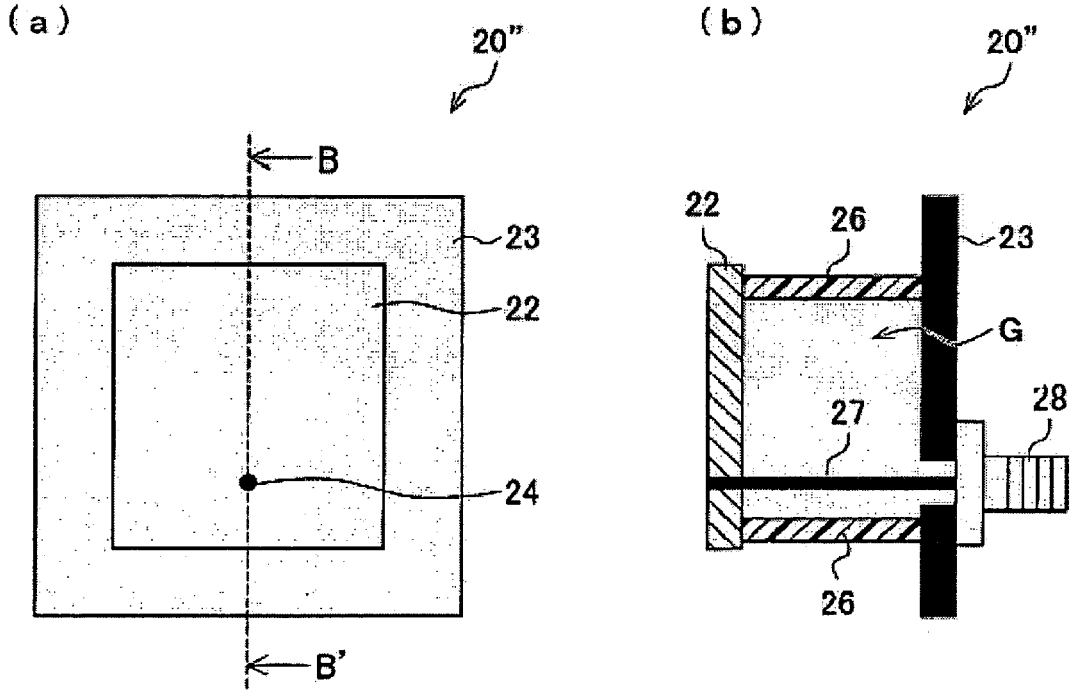
FIG. 13A is a plan view of a patch antenna in the related art.
FIG. 13B is a cross-sectional view seen from line B-B' of the patch antenna shown in FIG. 13A.
Figure 14:
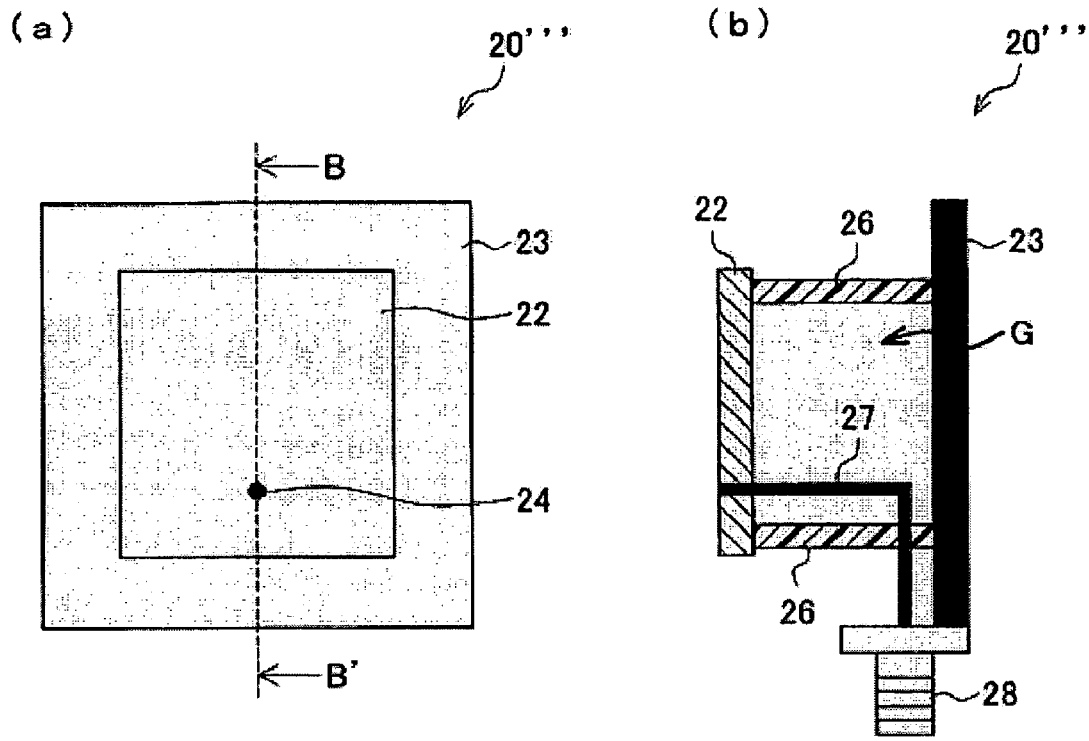
FIG. 14A is a plan view of a patch antenna in the related art.
FIG. 14B is a cross-sectional view seen from line B-B' of the patch antenna shown in FIG. 14A.
Figure 15:
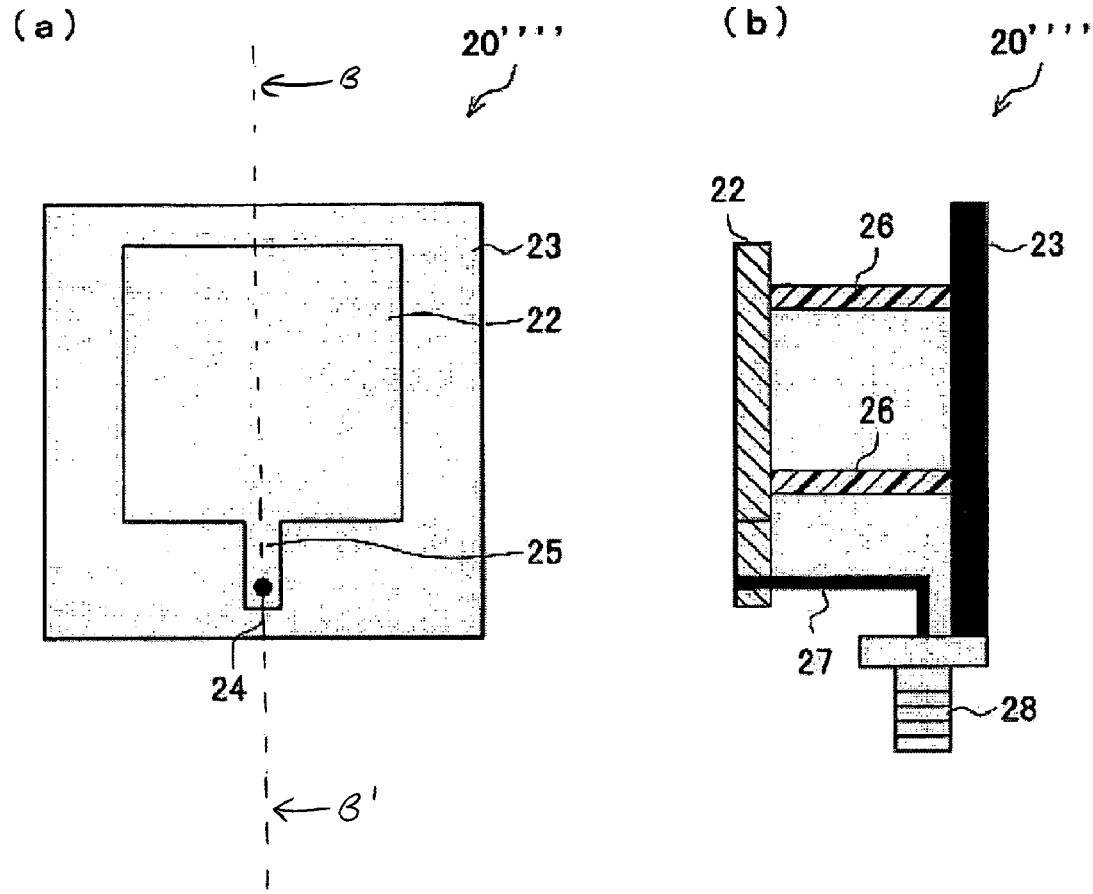
FIG. 15A is a plan view of a patch antenna in the related art.
FIG. 15B is a cross-sectional view seen from line B-B' of the patch antenna shown in FIG. 15A.

The central conductor 7 is connected to the above coaxial connector 8. The coaxial connector 8 is arranged on the side of the above grounding plate 2 for arranging the above radiating conductor 3 and the matching portion 4. For example, as in the conventional patch antenna 20 shown in FIGS. 13A and 13B, the coaxial connector 8 is not set to the construction arranged on the rear face side (the side on which the radiating conductor and the matching portion are not arranged) of the GND plate 23, but is arranged at an edge closest to the power supply portion 5 in the grounding plate 2 as shown in FIG. 2B.

Specifically, in the planar antenna 1 of this embodiment, wiring used in the power supply to the radiating conductor 3 and a member relative to this wiring are not arranged on the rear face side of the grounding plate 2. Thus, in the conventional patch antenna 20 shown in FIGS. 13A and 13B, there is an obstacle in the arrangement in a wall, but there is no obstacle in the arrangement in the wall by setting the construction of the present invention. Thus, the degree of freedom of the configuration can be improved.

Further, the matching portion 4 is arranged in a slanting state with respect to the grounding plate 2 in the space between the radiating conductor 3 and the grounding plate 2. Accordingly, the distance from the power supply portion 5 to the coaxial connector 8, i.e., the length of the central conductor 7 is very short in comparison with the conventional patch antenna. Hence, the planar antenna of the present invention can be manufactured by restraining manufacture cost.

Further, the central conductor 27 (FIGS. 13A, 13B, 14A and 14B) is conventionally arranged in an unstable state between the radiating conductor and the GND plate without arranging a member such as a support body, etc. Therefore, there is a possibility that the characteristics of the central conductor are deteriorated by a vibration and an impact in carrying the antenna at the manufacturing time of the antenna and after the manufacture, etc. In contrast to this, in the planar antenna 1, the length of the central conductor 7 is shortened in comparison with the conventional case. Therefore, the above unstable state can be avoided. Accordingly, it is possible to reduce the deterioration of the characteristics of the central conductor 7 due to a vibration and an impact in carrying the planar antenna 1 at the manufacturing time of the planar antenna 1 and after the manufacture, etc. Therefore, consistency of quality can be improved.

The above spacer 6 is arranged between the grounding plate 2 and the radiating conductor 3. The spacer 6 is arranged to maintain this distance between the grounding plate 2 and the radiating conductor 3 at a predetermined distance (specifically, the distance X of FIG. 2B). For example, as the material of the spacer 6, it is possible to use polyether sulfone (PPS), a liquid crystal polymer (LCP), syndiotactic polystyrene (SPS), polycarbonate (PC), polyethylene terephthalate (PET), epoxy resin (EP), polyimide resin (PI), polyetherimide resin (PEI), phenol resin (PF), etc.

In this embodiment, as shown in FIG. 1, the spacer 6 is arranged at each of four corners of the radiating conductor 3, but the present invention is not limited to this arrangement. The arranging position of the spacer 6 may be suitably set as long as no antenna characteristics are prevented. Further, the shape and arrangement number of the spacer 6 can be also suitably set.

Figure 3:
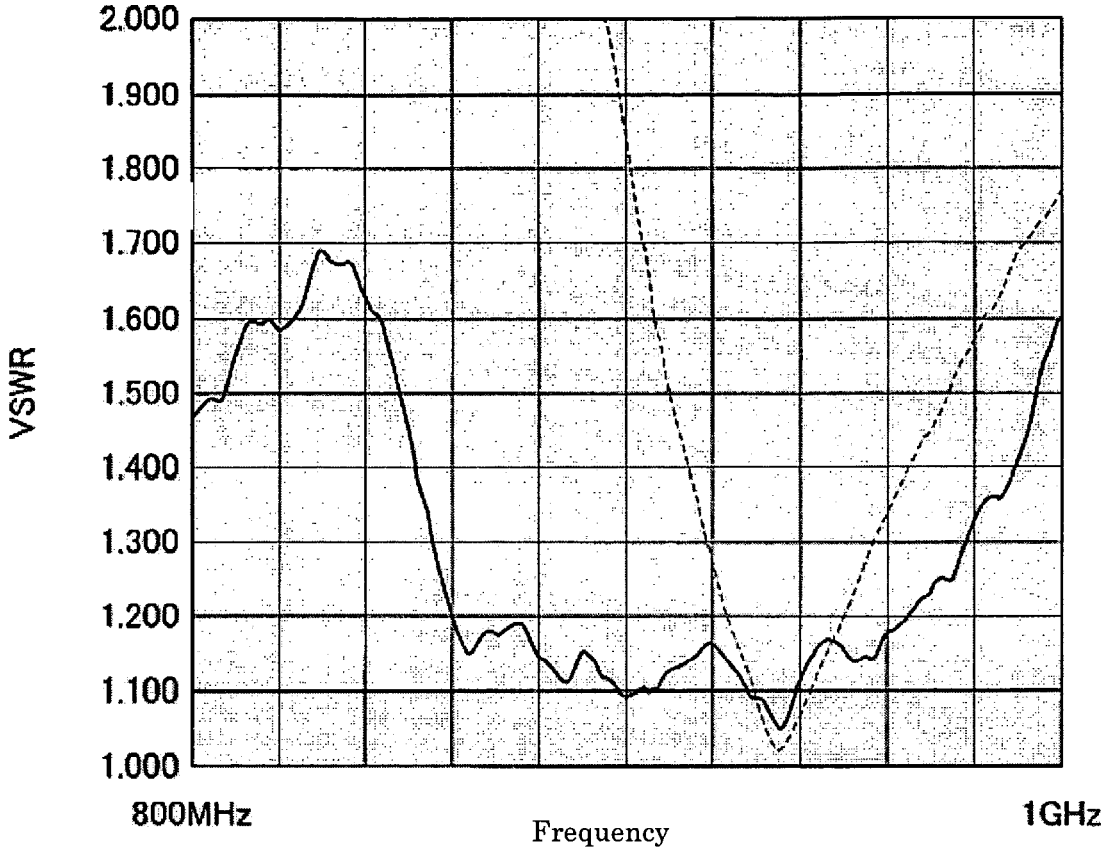
FIG. 3 is a graph showing a measuring result of VSWR (Voltage Standing Wave Ratio) of the planar antenna 1 shown in FIG. 1.

In the planar antenna 1 having the above construction, as shown in FIG. 2B, the grounding plate 2 and the radiating conductor 3 are spaced from each other by a predetermined distance X and are oppositely arranged. FIG. 3 shows a measuring result of VSWR (Voltage Standing Wave Ratio) of the planar antenna 1. The VSWR is a value showing a reflecting degree. A value 1 in VSWR shows a non-reflecting state, and it can be said that this value shows a best state as the antenna characteristics. Conversely, it shows that the reflection is increased as the VSWR is raised. Specifically, it can be said that preferable antenna characteristics are provided as the VSWR is lowered.

The measuring result shown in FIG. 3 is a measuring result of the VSWR in a 1 GHz band in a case using the planar antenna 1 in which the distance X between the radiating conductor 3 and the grounding plate 2 is set to 15 mm, and the distance Y between the power supply portion 5 and the grounding plate 2 is set to 4 mm. Further, the graph of FIG. 3 shows a maximum value of the VSWR. Further, in FIG. 3, the measuring result of the VSWR value of the antenna constructed so as to make the grounding plate and the radiating conductor come in contact with each other as shown in FIGS. 11A and 11B is shown by a broken line as a comparison collation.

Figure 11:
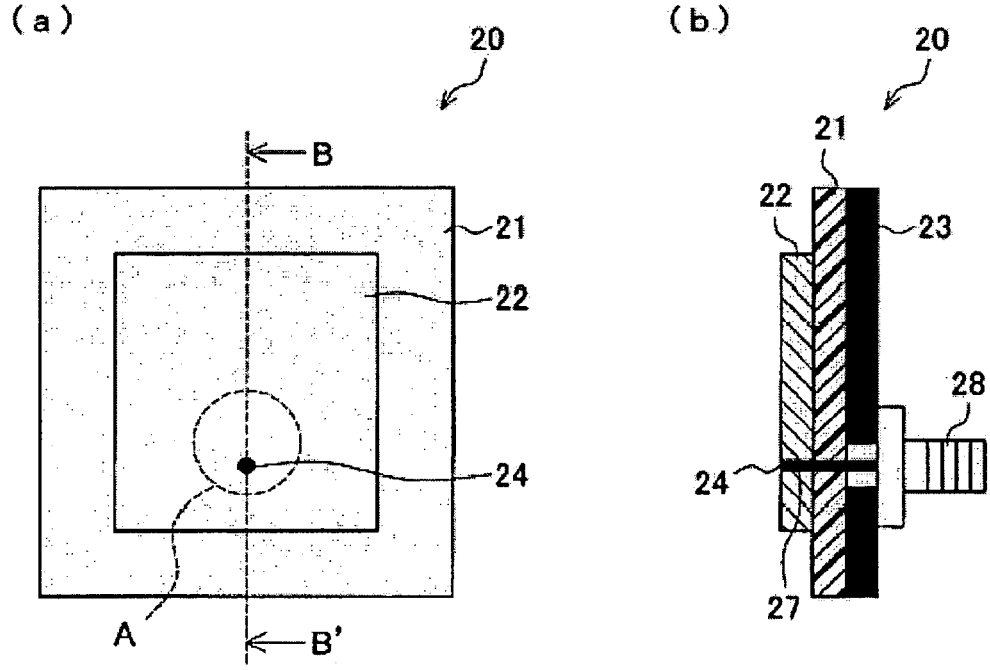
FIG. 11A is a plan view of a patch antenna in the related art.
FIG. 11B is a cross-sectional view seen from line B-B' of the patch antenna shown in FIG. 11A.
Figure 12:
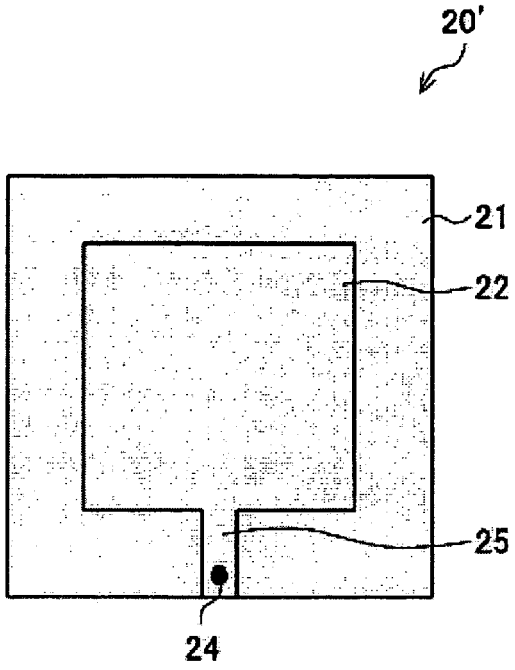
FIG. 12 is a plan view of a patch antenna in the related art.

It is understood from the measuring result of FIG. 3 that the Q-value is small and the frequency band is widely secured in the planar antenna 1 of this embodiment in comparison with the antenna (1.6 mm in the thickness of the substrate) constructed as shown in FIGS. 11A and 11B. For example, if the planar antenna 1 of this embodiment is used, a frequency band of 100 MHz can be secured in the 1 GHz band.

The distance X between the radiating conductor 3 and the grounding plate 2 can be suitably set in accordance with a using object (using band) of the planar antenna 1. For example, in the case of the UHF band antenna, the distance X is preferably set to a range of 10 mm to 30 mm, and is more preferably set to 15 mm.

In this embodiment, an air layer is formed between the radiating conductor 3 and the grounding plate 2 except for the spacer 6. Since the dielectric constant of the air is 1, it is possible to contribute to an increase in the frequency band of the planar antenna 1 by setting the air layer. Further, since no member is arranged between the radiating conductor 3 and the grounding plate 2, the planar antenna 1 can be provided at low cost. However, the present invention is not limited to this construction. A construction for arranging another member instead of the above air layer may also be set.

Further, when a material having a high dielectric constant is arranged in the air layer in this embodiment, a wavelength shortening effect is obtained. This wavelength shortening effect is an effect in which the wavelength of an electromagnetic wave transmitted within the dielectric is shortened in accordance with the value of the dielectric constant. If this effect is used, the antenna of a high dielectric constant can be reduced in size (for example, width R shown in FIG. 2A) in comparison with the antenna of a low dielectric constant when the planar antenna operated at the same frequency is considered. In this specification, the ratio of the dielectric constant ∈1 of a resin layer to the dielectric constant ∈0 of a space (the external space, normally the air layer) for radiating the radio wave from the planar antenna 1, i.e., ∈1/∈0 is defined as a relative dielectric constant of the above resin layer.

The material arranged instead of the air layer in this embodiment is not limited to one kind, but may be also constructed from plural kinds of materials. Further, the relative dielectric constants of these materials may be set to the same and may be also differently set.

The planar antenna 1 of this embodiment is constructed so as to have the rectangular radiating conductor 3 as mentioned above. However, the present invention is not limited to this construction, but the radiating conductor 3 may be also formed in other shapes, e.g., a square shape, a circular shape, and an elliptical shape. An electric current distribution according to the shape and size of the radiating conductor 3 is generated on the conductor, and the radio wave of a pattern determined by this electric current distribution is irradiated.

Further, in the planar antenna 1 in this embodiment, the above matching portion 4 is a flat plate, and is slantingly arranged with respect to the grounding plate 2. However, the present invention is not limited to this arrangement. For example, the inclination angle with respect to the grounding plate 2 is not limited to the above range, but the matching portion 4 may be also arranged perpendicularly to the grounding plate 2. Further, the matching portion 4 may be also set to a curved structure, a structure having irregularities and a stairway structure.

For convenience of the explanation, the above planar antenna 1 is constructed such that nothing is arranged on the radiating conductor 3. However, the present invention is not limited to this construction. For example, a protecting layer for protecting the radiating conductor 3 may be also arranged.

The planar antenna 1 having the above construction can be suitably used to transmit and receive the radio wave of a UHF (Ultra High Frequency) band having a frequency band of 300 MHz to 3 GHz. However, the present invention is not limited to this case, but can be also used in a base station antenna of a communication system of a portable telephone having a frequency band of 800 MHz to 1.5 GHz, and a base station antenna of a personal communication system of a PHS (Personal Handyphone System) of 1.9 GHz. Further, the present invention can be also applied to a wireless LAN (2.4 GHz) and a UWB (Ultra Wide Band) band having a frequency band of 3.1 GHz to 10.6 GHz.

Figure 4:
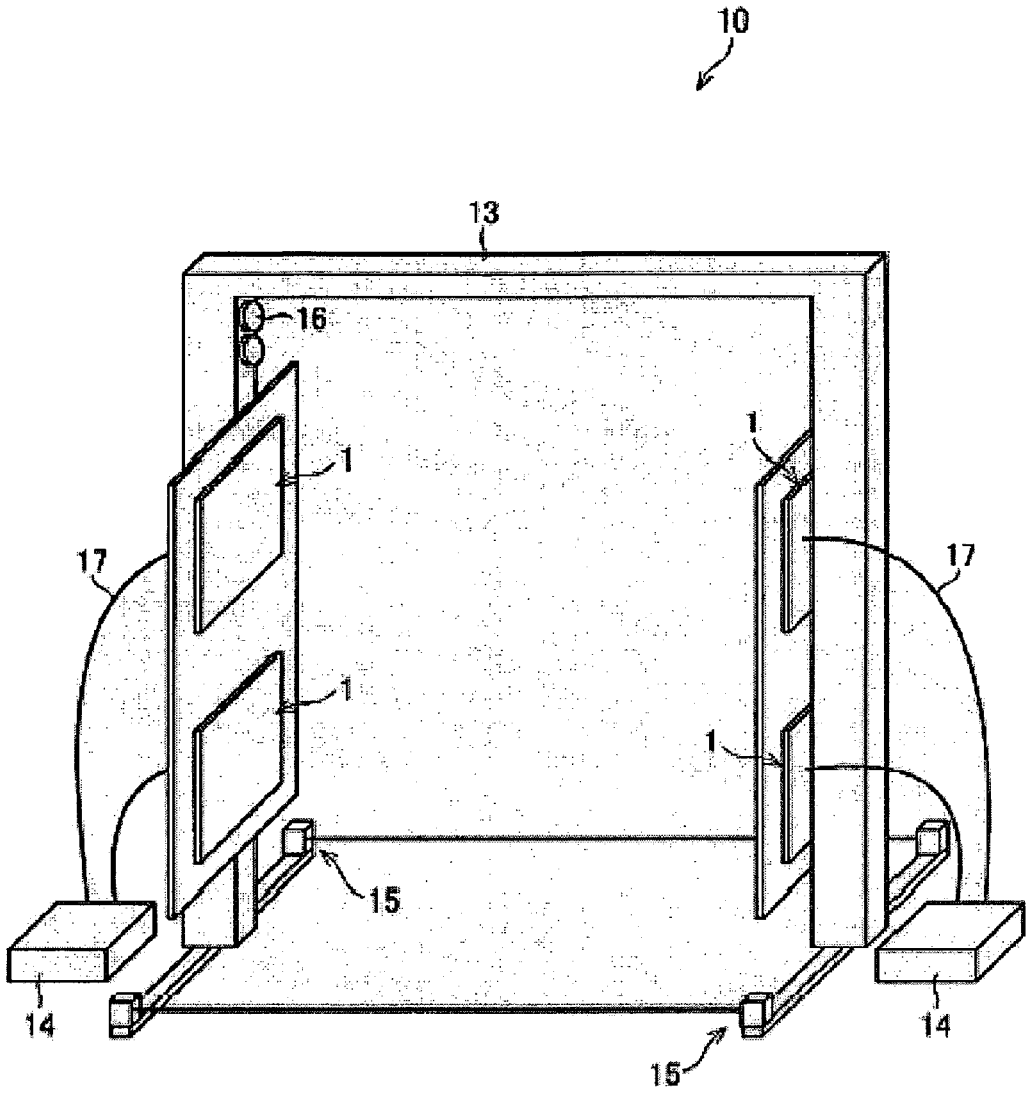
FIG. 4 is a perspective view showing the outer shape of a gate antenna in the present invention to which the planar antenna shown in FIG. 1 is applied.

Next, a gate antenna (antenna device) having the above planar antenna will be explained with respect to FIG. 4. FIG. 4 is a perspective view showing the outer shape of the gate antenna 10 applying the planar antenna of the present invention thereto.

For example, the above gate antenna 10 is arranged in a circulating managing spot of articles, etc. An article 11 (FIG. 5) and a conveying device (e.g., a forklift) 12 (FIG. 5) for transporting this article pass this gate antenna 10. Thus, it is possible to manage information such as carrying-in, carrying-out of the article 11, etc.

The gate antenna 10 has at least the above planar antenna 1, a reader-writer 14 and a gate 13. Further, the gate antenna 10 of this embodiment has an area (advance/retreat) detecting sensor 15 and a lamp 16.

The reader-writer 14 can receive information transmitted from the planar antenna 1, and can transmit information to the planar antenna 1.

The gate 13 mounts the planar antenna 1 and the lamp 16 thereto. The size of the gate 13 is not particularly limited, but can be suitably set in accordance with an arranging spot of the gate antenna 10.

The above area (advance/retreat) detecting sensor 15 is arranged to detect that the article 11 and the conveying device 12 for transporting this article are advanced into the gate antenna 10 and/or are retreated from the gate antenna 10. The above lamp 16 is turned on and off on the basis of information of the area (advance/retreat) detecting sensor 15 and/or information transmitted from the planar antenna 1 to the reader-writer 14.

The arranging positions and the arranging numbers of the area (advance/retreat) detecting sensor 15, the reader-writer 14, the lamp 16 and the planar antenna 1 are not limited to this embodiment, but can be suitably set.

In this embodiment, as shown in FIG. 4, the planar antenna 1 and the reader-writer 14 are connected by a cable 17, but the present invention is not limited to this connection. The planar antenna 1 and the reader-writer 14 may be also constructed so as to transmit and receive information by wireless communication.

Further, as shown in FIG. 4, the gate antenna 10 of this embodiment is constructed such that the planar antenna 1 is arranged on each of both the internal sides of the gate 13. However, the present invention is not limited to this configuration.

Figure 5:
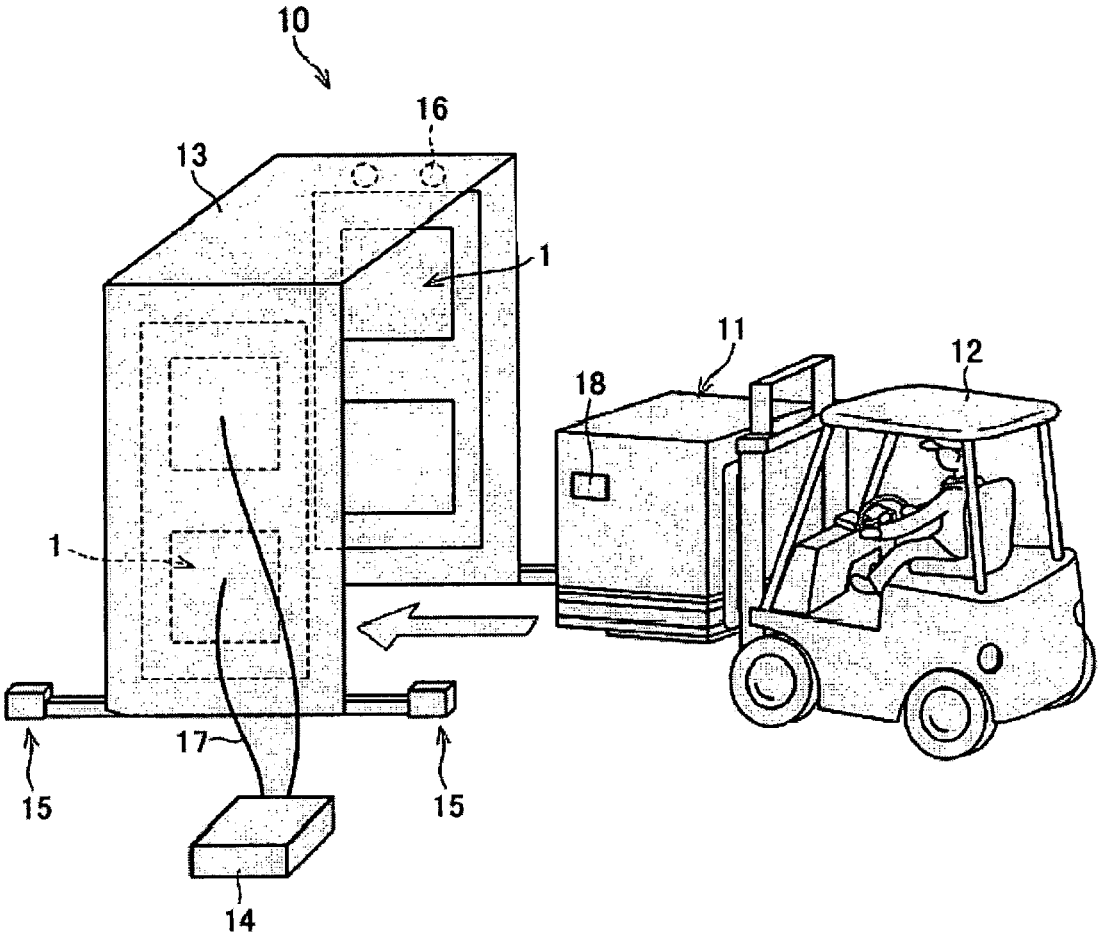
FIG. 5 is a schematic view for explaining an article managing system (RFID system) using the gate antenna in this embodiment.

FIG. 5 is a schematic view for explaining an article managing system (RFID system) using the gate antenna 10 in this embodiment. In FIG. 5, the information of a RFID label 18 is read by using the gate antenna 10 mounting the planar compact antenna 1 as shown in FIG. 4. Information such as an article number, a manufacture lot, etc. relative to the article is inputted to the RFID label 18 attached to the article. The gate antenna 10 reading these information by the planar antenna 1 transmits this information to the reader-writer 14 by using the cable 17. The information transmitted from the gate antenna 10 is received by a modem (not shown) arranged within the reader-writer 14, and is decoded by a main circuit (not shown) such as a CPU, etc. arranged within the reader-writer 14. The lamp 16 of the gate antenna 10 is turned on and off in accordance with necessity on the basis of the decoded information.

As mentioned above, the gate antenna of the present invention has the above planar antenna 1. Therefore, even when this planar antenna 1 is arranged in the gate 13, the space required in the configuration can be reduced as compared to the conventional case.

As shown in FIGS. 4 and 5, the reader-writer 14 can be arranged in a location in which it is difficult to make a collision outside the gate 13. However, since the planar antenna 1 is required to be located on the front face of a signal transmitting source of the received information, the arrangement is restricted. In this case, in the conventional antenna in which the coaxial connector, etc. are arranged on the rear face of the antenna (GND plate), it is not easy to arrange the antenna in the gate 13. Specifically, the antenna is projected from a wall of the gate 13. When the antenna is excessively projected forward from the wall, there is a high possibility that the antenna comes in contact with the article 11 and the conveying device 12 moved within the gate 13 and both the antenna, the article 11, and the conveying device 12 are damaged. Therefore, if the gate antenna 10 of this embodiment is used, no coaxial connector 8 is arranged on the rear face of the grounding plate 2 of the planar antenna 1. Therefore, the configuration space can be reduced. Accordingly, compactness of the gate antenna 10 itself can be realized.

Further, the horizontal size of the gate antenna 10 can be reduced with respect to the wall of the gate 13 by arranging the planar antenna 1. Specifically, in the planar antenna 1, as mentioned above, the matching portion 4 is closely arranged in the space from the grounding plate to the radiating conductor, and this space is effectively utilized. Therefore, the surface area of the antenna can be set to be smaller than that of the conventional antenna having the matching portion. Accordingly, more planar antennas 1 can be also arranged within a predetermined area of the wall of the gate 13 by arranging the planar antennas 1 in the gate antenna 10.

In this embodiment, the gate antenna 10 has been explained, but the antenna device of the present invention is not limited to this gate antenna 10. It is sufficient if the antenna device is constructed so as to arrange the planar antenna and the reader-writer. The present invention can be also applied to a conveyer antenna as well as the gate antenna. In addition, the present invention can be also applied to stationary, overhead, forklift antennas, etc.

(Embodiment 2)

Figure 7:
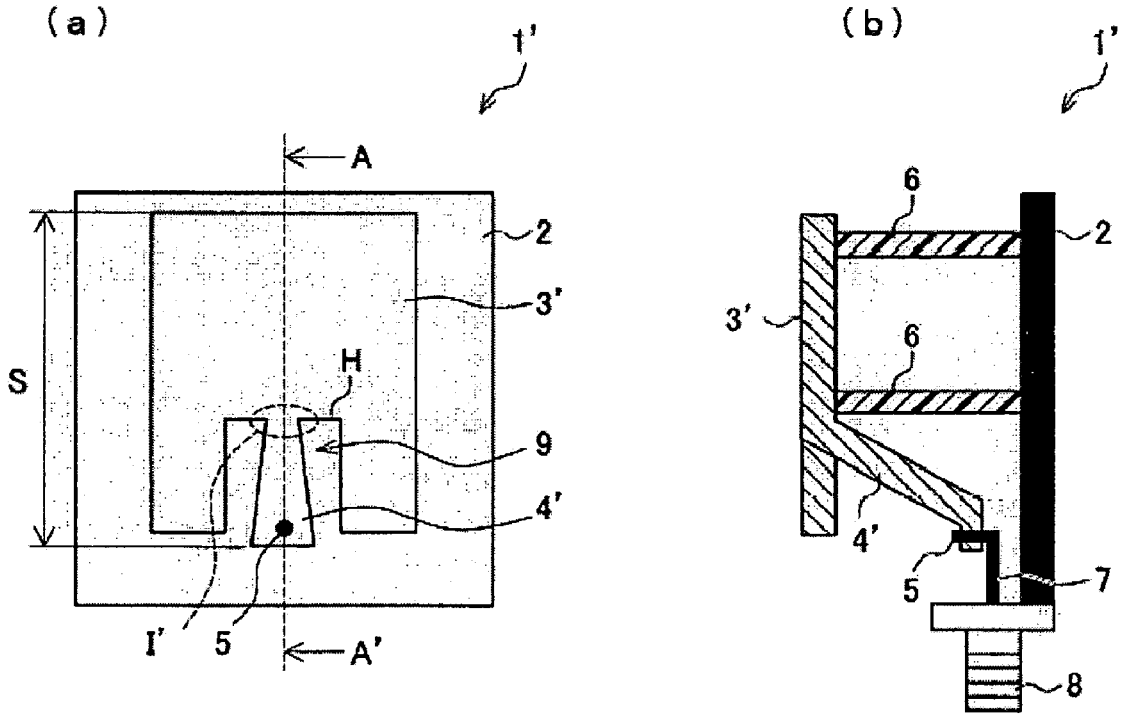
FIG. 7A is a plan view of the planar antenna shown in FIG. 6.
FIG. 7B is a cross-sectional view seen from line A-A' of the planar antenna shown in FIG. 7A.
Figure 8:
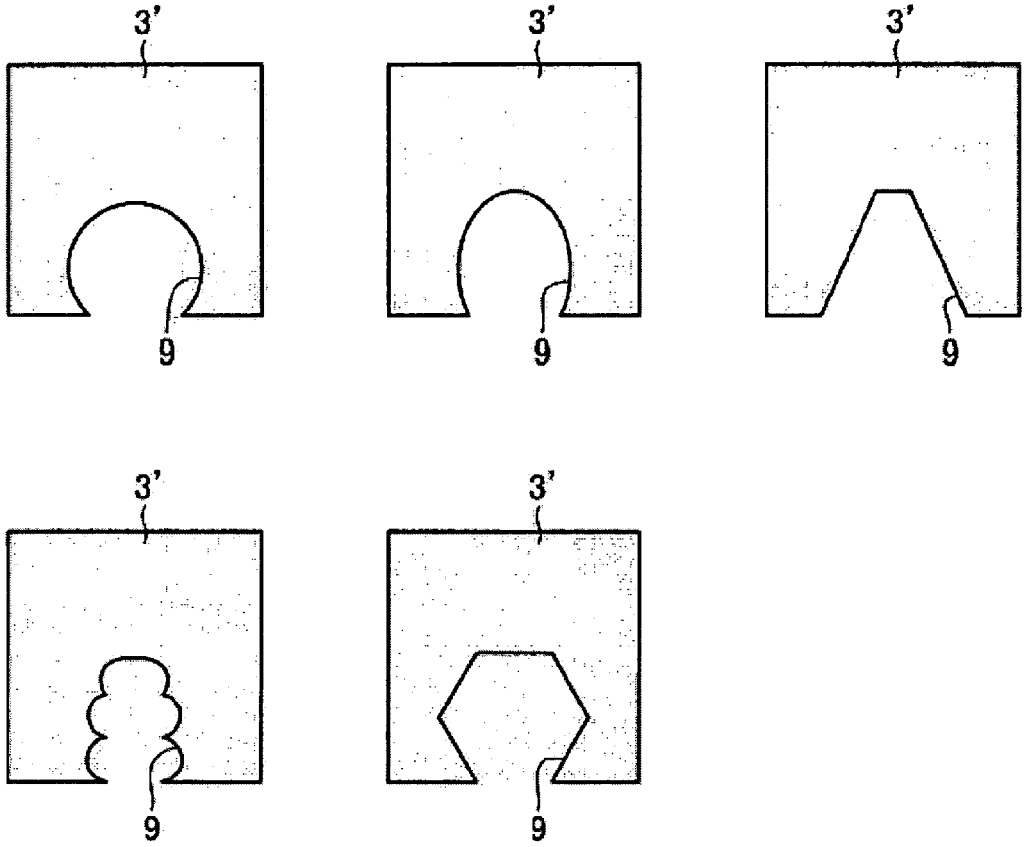
FIG. 8 is a plan view showing modified examples of a notch portion arranged in the planar antenna shown in FIG. 6.

Another exemplary embodiment of the present invention will be explained as follows with respect to FIGS. 6 to 8.

In this embodiment, the difference points between the above first embodiment antenna 1 and this embodiment will be explained. Therefore, for convenience of the explanation, the same reference numerals are designated in members having functions similar to those of members explained in the embodiment 1, and their explanations are omitted.

Figure 6:
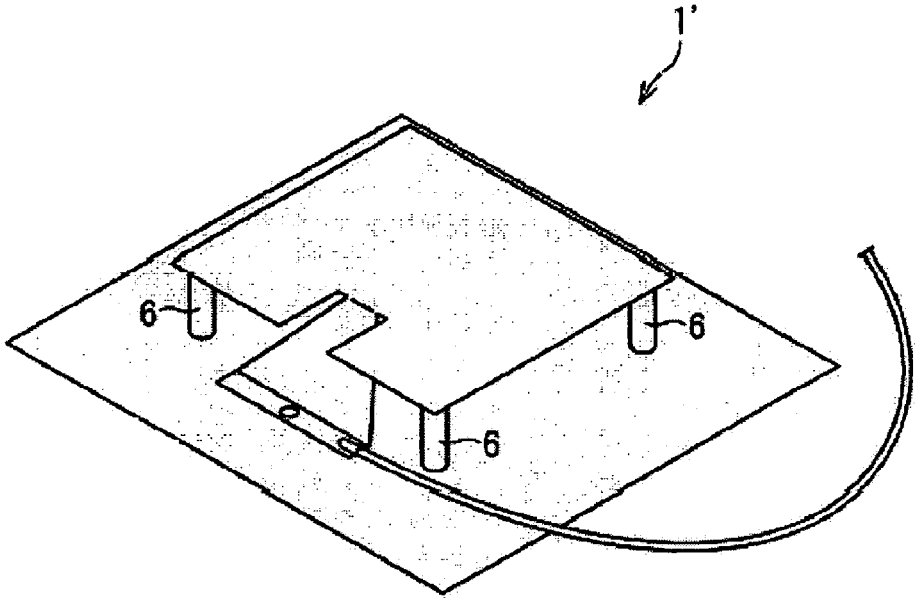
FIG. 6 is a perspective view showing the outer shape of a planar antenna in another exemplary embodiment of the present invention.

FIG. 6 is a perspective view showing the outer shape of a planar antenna 1' in this embodiment. FIGS. 7A and 7B show the construction of the planar antenna 1'. FIG. 7A is a plan view of the planar antenna 1'. FIG. 7B is a cross-sectional view seen from a direction in which the planar antenna 1' shown in FIG. 7A is cut by a line segment A-A'.

In the above embodiment of antenna 1, the radiating conductor 3 has a so-called rectangular shape in which one of two pairs of opposite sides is longer than the other. In contrast to this, as shown in FIG. 3 and FIG. 7A, the planar antenna 1' of this embodiment is constructed so as to arrange a notch portion 9 in a radiating conductor 3' in a connecting area with a matching portion 4' in the radiating conductor 3'.

Specifically, in the planar antenna 1' of this embodiment, the notch portion 9 is arranged in the above radiating conductor 3 toward its center. One end of the matching portion 4 is connected to a side H of the central side of the radiating conductor 3 in the outer circumference of this notch portion 9.

The impedance of the radiating conductor 3 is reduced in proportion to the distance from its edge. Specifically, the central portion of the radiating conductor 3 is lower in impedance than its edge. Therefore, as shown in FIG. 7A, in the planar antenna 1' of this embodiment, the notch portion 9 is arranged in the above radiating conductor 3 toward its center. The side H of this notch portion 9 and the matching portion 4 are connected. Thus, power can be supplied from the center of the radiating conductor 3 low in impedance. Thus, for example, when the impedance of a signal inputted from a communication device, etc. is 50 ohms, the impedance can be more accurately matched, and loss due to reflection can be further reduced.

Further, since the matching portion 4 is connected to the center (the side H of the notch portion 9) of the radiating conductor 3', the matching portion can be easily manufactured at a manufacturing time in comparison with a case in which the matching portion 4 is connected to the edge of the radiating conductor 3. For example, as explained in the above embodiment 1, when the matching portion 4 (FIG. 1 and FIGS. 2A and 2B) is connected to the edge of the radiating conductor 3, it is necessary to elongate the shape of the matching portion 4 so as to match the respective impedances in the connecting area I of the radiating conductor 3 and the matching portion 4. However, a comparatively strict manufacturing accuracy is required to elongate the matching portion 4. Thus, throughput of the manufacturing is reduced. In contrast, in the construction of this embodiment, the matching portion 4 is connected in the central portion of the radiating conductor 3'. Therefore, it is not necessary to elongate the matching portion 4 as mentioned above. For example, the matching portion 4 can be formed largely similar to the above shape.

Accordingly, in the case of the planar antenna 1', the planar antenna can be easily manufactured without requiring high manufacturing accuracy with respect to the matching portion 4 in comparison with the case in which the matching portion 4 is connected to the edge of the radiating conductor 3. Thus, the throughput of the manufacturing of the planar antenna 1' can be improved. Therefore, manufacturing cost of the planar antenna 1' itself can be even more reduced.

In this embodiment, the notch portion 9 has the elongated shape directed to the central portion of the radiating conductor 3. However, the present invention is not limited to this shape. If the matching portion 4 can be connected to the central portion of the radiating conductor 3, i.e., if one portion of the outer circumference of the notch portion 9 is formed in the central portion of the radiating conductor 3, there is no restriction to its shape. FIG. 8 shows other shapes of the notch portion 9. For convenience of the explanation, the grounding plate 2, the matching portion 4 and the power supply portion 5 are omitted in FIG. 8. As shown in FIG. 8, for example, the notch portion 9 may be formed in a circular shape, and may be also formed in an elliptical shape. The notch portion 9 may be also formed in the shape of an arranging state of plural circular shapes, and may be also formed in a rectangular shape (a trapezoidal shape and a hexagonal shape), etc. except for the above shapes.

(Embodiment 3)

Another exemplary embodiment of the present invention will be explained as follows with respect to FIGS. 9 and 10.

In this embodiment, the difference points between this embodiment and the above embodiment of antenna 1 will be explained. Therefore, for convenience of the explanation, the same reference numerals are designated in members having functions similar to those of members explained in the embodiment of antenna 1, and their explanations are omitted.

Figure 9:
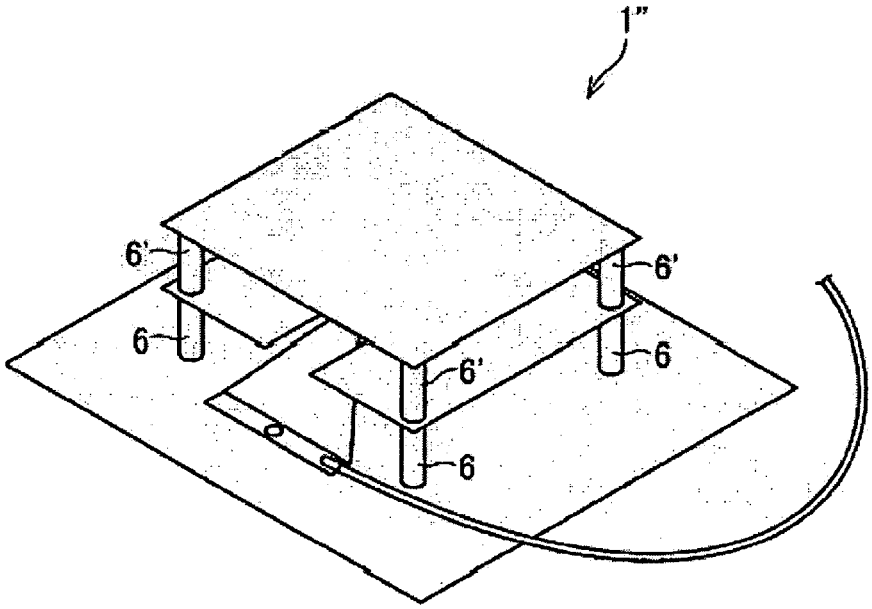
FIG. 9 is a perspective view showing the outer shape of a planar antenna in another exemplary embodiment of the present invention.
Figure 10:
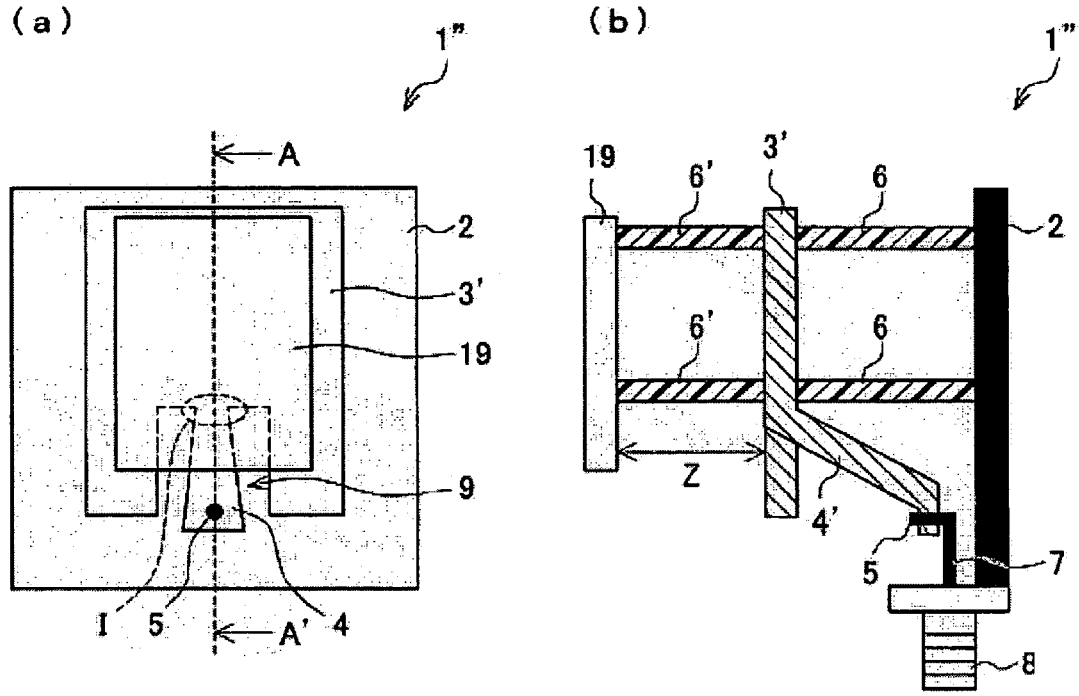
FIG. 10A is a plan view of the planar antenna shown in FIG. 9.
FIG. 10B is a cross-sectional view seen from line A-A' of the planar antenna shown in FIG. 10A.

FIG. 9 is a perspective view showing the outer shape of a planar antenna 1" in this embodiment. FIGS. 10A and 10B show the construction of the planar antenna 1". FIG. 10A is a plan view of the planar antenna 1" in which one portion of this plan view is a perspective view. FIG. 10B is a cross-sectional view seen from a direction in which the planar antenna 1" shown in FIG. 10A is cut by a line segment A-A'.

In the above embodiment of antenna 1, the radiating conductor 3 has a so-called rectangular shape in which one of two pairs of opposite sides is longer than the other. In contrast to this, in the planar antenna 1" of this embodiment, as shown in FIG. 9 and FIG. 10A, a notch portion 9 is arranged in a radiating conductor 3' in a connecting area with a matching portion 4' in the radiating conductor 3'. Further, a parasitic element 19 having a size smaller than that of the radiating conductor 3' is spaced from the radiating conductor 3' by a predetermined distance Z on the side opposed to the grounding plate 2 in the radiating conductor 3', and is arranged so as to be opposed to the radiating conductor 3', a separate resonance frequency is provided by arranging the parasitic element 19 having a size different from that of the radiating conductor 3'. Therefore, a wider frequency band can be secured.

The material of the parasitic element 19 is not particularly limited if this parasitic element 19 is formed by an electrically conductive material. However, if processing property and corrosive property are considered, it is possible to use a material in which plating processing is performed with respect to brass (BS).

A spacer 6' for maintaining the distance Z is arranged between the parasitic element 19 and the radiating conductor 3'. Similar to the spacer 6 arranged between the radiating conductor 3' and the grounding plate 2, for example, polyether sulfone (PPS), a liquid crystal polymer (LCP), syndiotactic polystyrene (SPS), polycarbonate (PC), polyethylene terephthalate (PET), epoxy resin (EP), polyimide resin (PI), polyetherimide resin (PEI), phenol resin (PF), etc. can be used as a material of the spacer 6'.

In this embodiment, as shown in FIG. 9, the spacer 6' is arranged at each of four corners of the rectangular parasitic element 19. However, the present invention is not limited to this arrangement. The arranging position can be suitably set as long as the antenna characteristics are not prevented. Further, the shape and arranging number of the spacer 6' can be also suitably set.

For example, the distance Z between the above radiating conductor 3' and the parasitic element 19 can be set to a range of 3 to 5 mm, and is preferably set to 4 mm. However, the present invention is not limited to these values.

As mentioned above, the planar antenna 1" of this embodiment has a separate resonance frequency by arranging the parasitic element 19 having a size different from that of the radiating conductor 3'. Therefore, a wider frequency band can be secured.

The present invention can provide a planar antenna for connecting the matching portion to the radiating element, and having a wide frequency band and high reliability by arranging this matching portion utilizing the air gap area of the radiating conductor and the grounding plate.

Accordingly, for example, the present invention can be applied to a base station antenna of a communication system of a portable telephone and a PHS, etc. Further, the present invention can be widely applied to a gate antenna, a RFID system, etc. by constructing the planar antenna in the present invention together with the reader-writer.

What is claimed as new and desired to be protected by Letters Patent of the United States is:

1. A planar antenna comprising:

a radiating conductor and a grounding plate spaced from each other by a predetermined distance and oppositely arranged; and a matching portion in which a power supply portion for supplying power to said radiating conductor is arranged at one end of the matching portion, and another end of said matching portion is connected to said radiating conductor, wherein said matching portion is spaced apart from the ground plate and is arranged such that said power supply portion and said grounding plate are spaced from each other by a distance shorter than said predetermined distance, wherein said matching portion is arranged such that the distance between said matching portion and said grounding plate is gradually shortened from an end connected to said radiating conductor to an end having said power supply portion, and wherein a central conductor connected to said power supply portion, and a coaxial connector formed on a coaxial line path with said central conductor are arranged on an arranging side of said radiating conductor and said matching portion in said grounding plate.

2. The planar antenna according to claim 1, wherein a notch portion is arranged in said radiating conductor from its outer circumference to its center, and one end of said matching portion is connected to an outer edge of a central side of said notch portion.

3. The planar antenna according to claim 2, wherein said matching portion is gradually widened in width from an end connected to said radiating conductor to an end having said power supply portion.

4. The planar antenna according to claim 3, wherein a parasitic element is arranged on the side opposed to said arranging side of said grounding plate in said radiating conductor such that said parasitic element is spaced from said radiating conductor by a predetermined distance and is opposed to said radiating conductor.

5. The planar antenna according to claim 2, wherein a parasitic element is arranged on the side opposed to said arranging side of said grounding plate in said radiating conductor such that said parasitic element is spaced from said radiating conductor by a predetermined distance and is opposed to said radiating conductor.

6. The planar antenna according to claim 1, wherein said matching portion is gradually widened in width from an end connected to said radiating conductor to an end having said power supply portion.

7. The planar antenna according to claim 6, wherein a parasitic element is arranged on the side opposed to said arranging side of said grounding plate in said radiating conductor such that said parasitic element is spaced from said radiating conductor by a predetermined distance and is opposed to said radiating conductor.

8. The planar antenna according to claim 1, wherein a parasitic element is arranged on the side opposed to said arranging side of said grounding plate in said radiating conductor such that said parasitic element is spaced from said radiating conductor by a predetermined distance and is opposed to said radiating conductor.

9. A planar antenna comprising:

a radiating conductor and a grounding plate spaced from each other by a predetermined distance and oppositely arranged;

and a matching portion in which a power supply portion for supplying power to said radiating conductor is arranged at one end of the matching portion, and another end of said matching portion is connected to said radiating conductor, wherein said matching portion is spaced apart from the ground plate and is arranged such that said power supply portion and said grounding plate are spaced from each other by a distance shorter than said predetermined distance, and wherein said matching portion is gradually widened in width from an end connected to said radiating conductor to an end having said power supply portion.

10. The planar antenna according to claim 9, wherein said matching portion is arranged such that the distance between said matching portion and said grounding plate is gradually shortened from an end connected to said radiating conductor to an end having said power supply portion.

11. The planar antenna according to claim 10, wherein a parasitic element is arranged on the side opposed to an arranging side of said grounding plate in said radiating conductor such that said parasitic element is spaced from said radiating conductor by a predetermined distance and is opposed to said radiating conductor.

12. The planar antenna according to claim 9, wherein a central conductor connected to said power supply portion, and a coaxial connector formed on a coaxial line path with said central conductor are arranged on an arranging side of said radiating conductor and said matching portion in said grounding plate.

13. The planar antenna according to claim 12, wherein a parasitic element is arranged on the side opposed to said arranging side of said grounding plate in said radiating conductor such that said parasitic element is spaced from said radiating conductor by a predetermined distance and is opposed to said radiating conductor.

14. The planar antenna according to claim 9, wherein a parasitic element is arranged on the side opposed to an arranging side of said grounding plate in said radiating conductor such that said parasitic element is spaced from said radiating conductor by a predetermined distance and is opposed to said radiating conductor.

15. The planar antenna according to any one of claims 1, 2 to 6, 3, 8, 5 to 7, and 4, wherein said planar antenna is coupled to a reader-writer for receiving information transmitted from said planar antenna, and/or transmitting information to said planar antenna.

16. The planar antenna according to any one of claims 1, 2 to 6, 3, 8, 5 to 7, and 4, wherein said planar antenna is coupled to a reader-writer for receiving information recorded to a wireless IC tag transmitted from said planar antenna, and/or transmitting said information recorded to said wireless IC tag to said planar antenna.

* * * * *